US005564983A

United States Patent [19]

Larson

[11] Patent Number: 5,564,983

[45] Date of Patent: Oct. 15, 1996

[54] TOWER RIDE

[76] Inventor: Walter F. Larson, 1401 Borger, Plainview, Tex. 79072

[21] Appl. No.: 191,161

[22] Filed: Feb. 2, 1994

[51] Int. Cl.[6] ..... A63G 1/28

[52] U.S. Cl. ..... 472/3; 472/29; 472/32

[58] Field of Search ..... 472/1, 2, 3, 131, 472/29, 31, 34, 33

[56] References Cited

U.S. PATENT DOCUMENTS

| | | | |
|---|---|---|---|
| 865,584 | 9/1907 | Fulton et al. . | |
| 1,563,122 | 11/1925 | Uzzell . | |
| 1,712,340 | 5/1929 | Fankhauser et al. . | |
| 1,854,473 | 4/1932 | Laborda . | |
| 2,525,458 | 10/1950 | Peterson . | |
| 2,848,231 | 8/1958 | Propst . | |
| 3,176,983 | 4/1965 | Barber . | |
| 3,633,904 | 1/1972 | Kojima . | |
| 3,787,046 | 1/1974 | Clem . | |
| 3,840,225 | 10/1974 | Fouche . | |
| 3,863,407 | 2/1975 | Eucken . | |
| 3,874,136 | 4/1975 | Michel . | |
| 3,905,596 | 9/1975 | Barber . | |
| 4,152,933 | 5/1979 | Woodhouse | 73/189 |
| 4,917,374 | 4/1990 | Petz | 472/29 X |
| 5,046,719 | 9/1991 | Comstock et al. . | |
| 5,209,361 | 5/1993 | Grubb, Jr. | 212/158 |

OTHER PUBLICATIONS

Four (4) photographs of Hy–Ball device, 1959.

*Primary Examiner*—Kien T. Nguyen
*Attorney, Agent, or Firm*—Richards, Medlock & Andrews

[57] ABSTRACT

An amusement ride (10) is provided which includes a trailer (12) to make the ride portable. A park ride (10') is also disclosed for permanent installation at an amusement park or similar facility. In the portable ride (10), the tower (14) is moved by a double acting hydraulic cylinder (26) along the trailer from the transport position to a position where it is hingeably mounted to the trailer (12) by a hinge support (32). The double acting hydraulic cylinder (26) is also used to lift the tower to the erected position once the tower assembly is hinged to hinge support 32. In both the portable ride (10) and park ride (10'), the tower includes a lower section (16) and an upper section (18). A hydraulic cylinder lifts the upper section relative to the lower section. Cables (46) extend between a gondola and the lower section and are guided on pulleys over the upper end of the upper section. As the upper section moves vertically, the gondola will move vertically at about twice the velocity of the upper section.

24 Claims, 11 Drawing Sheets

TOWER RIDE

TECHNICAL FIELD OF THE INVENTION

This invention relates to an amusement ride which can be portable with ease of transport and erection or permanently mounted in an amusement park or similar facility.

BACKGROUND OF THE INVENTION

Amusement rides are popular among both young and old. An example of one amusement ride is disclosed in U.S. Pat. No. 5,046,719 to Comstock et al. Because of the cost and difficulty of maintaining an amusement park, a large industry has developed in temporary amusement sites which can be readily set up on a fairground, shopping mall parking lot or a community park. These activities put a premium on the quick and efficient installation and erection of the amusement rides and other facilities.

A need always exists for improved amusement rides which are more fun for users and more efficient and quickly set up by the operators. In addition to the quality of the ride, it is important that the appearance of the device be attractive to visitors, both during the installation and erection of the device and during use.

SUMMARY OF THE INVENTION

In accordance with one aspect of the present invention, an apparatus is provided for erecting a tower assembly on a platform. The invention includes a platform and a tower assembly having a base end and an upper end. The tower assembly is movable between a storage position and an erected position on the platform. A double acting hydraulic cylinder is mounted between the platform and the tower assembly moving the tower assembly relative to the platform with the base end moving from a first position to a second position. Pivot structure is mounted on the platform to hingeably secure the base end of the tower assembly in the second position. The hydraulic cylinder pivots the tower assembly about the pivot structure to lift the tower assembly to the erected position.

The double acting hydraulic cylinder stays attached to the tower at all times with the exception of when the ride is being operated. This is important as it greatly reduces labor of having to attach and detach the cylinder each time the tower is moved, i.e., when the ride is being sloughed from the vertical to the horizontal and vice versa, the hydraulic cylinder is attached to the tower while the tower is in the vertical position. The cylinder then lowers the tower, moves the tower aft for transport, pulls the tower forward to the locks and then stands the tower back up. All of this is done with the double acting cylinder attached at all times. After the tower is stood up and made ready for ride operation, the cylinder is detached at the tower point only, retracted and lowered into the well in the floor or trailer, out of the way.

In accordance with another aspect of the present invention, an amusement ride is provided which has a lower section and an upper section. A device for lifting the upper section vertically relative to the lower section is provided which lifts the upper section between a retracted position and an extended position. A gondola is moveable along the upper section and at least one constant length flexible member is attached at one end to the gondola and to the other end to the lower section with the member passing over the upper end of the upper section. The lifting of the upper section to the extended position lifts the gondola through the flexible member at a rate twice as fast as the upper section is lifted.

BRIEF DESCRIPTION OF THE DRAWINGS

For a more complete understanding of the present invention and for further advantages thereof, reference is now made to the following description of the preferred embodiment, taken in conjunction with the accompanying drawings, in which.

DETAILED DESCRIPTION

Figure 1:
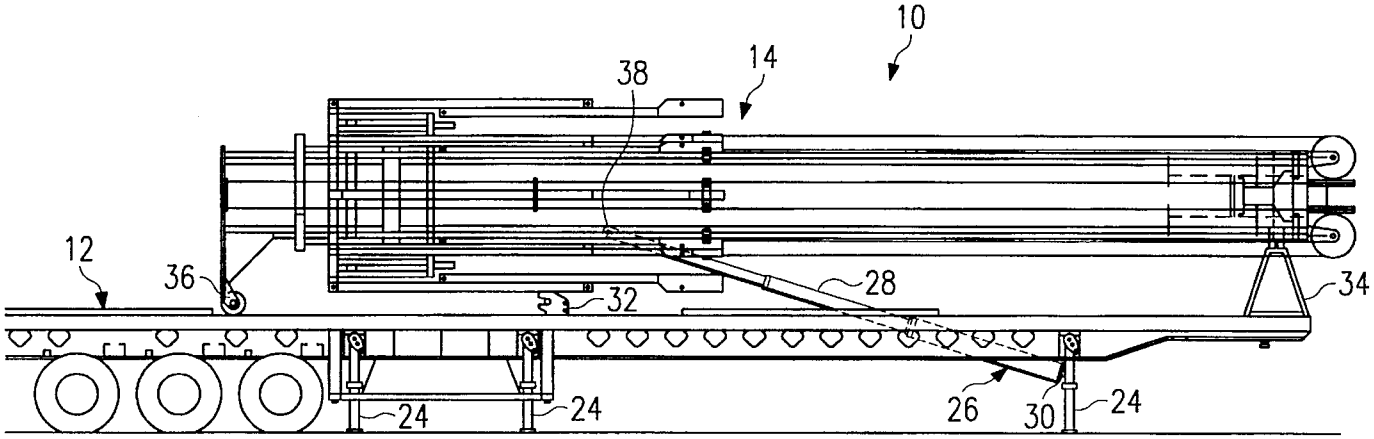
FIG. 1 is a side view of an amusement ride forming a first embodiment of the present invention shown in the transport position.
Figure 5:
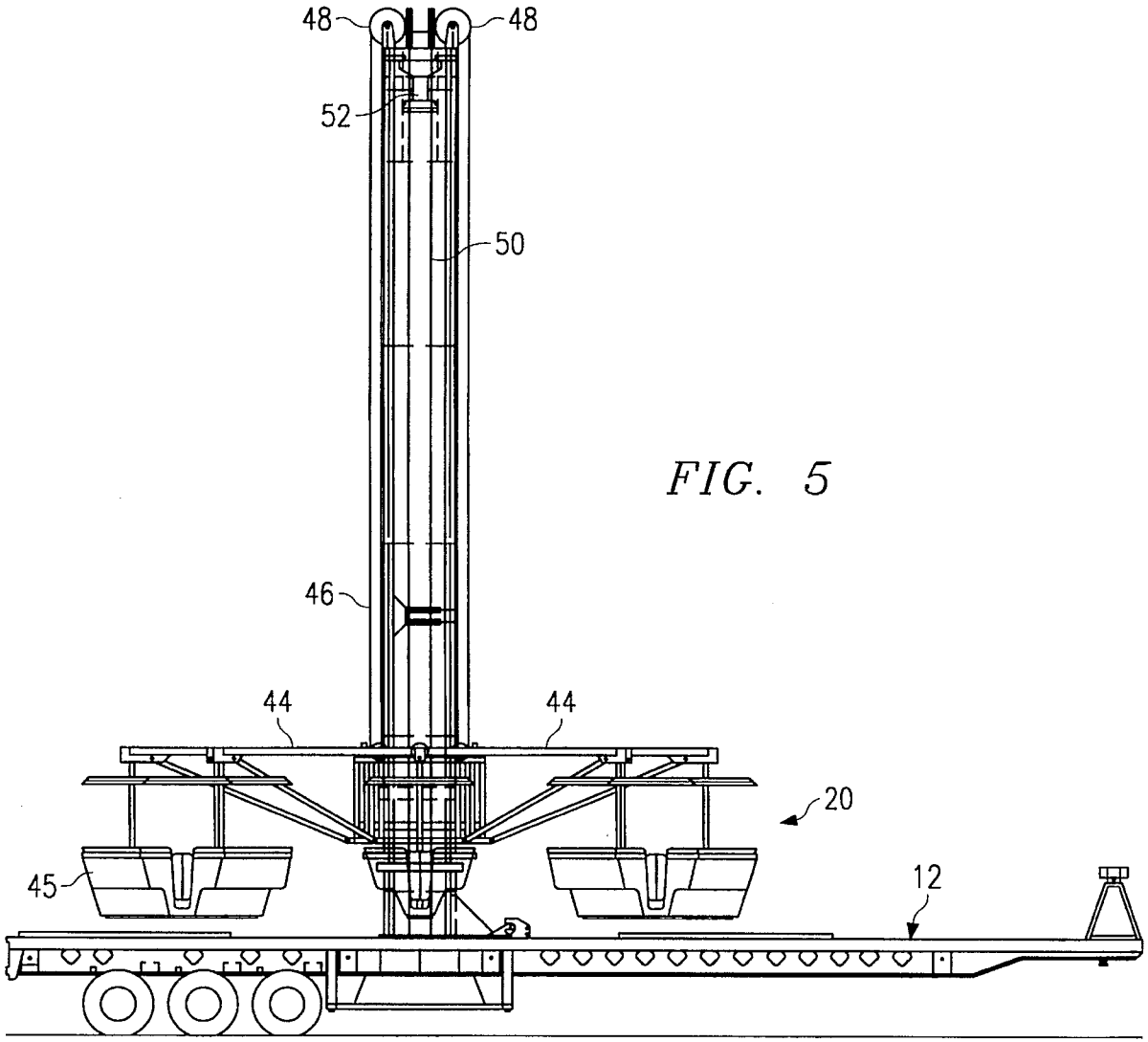
FIG. 5 is a side view of the amusement ride showing the gondola cars deployed.
Figure 6:
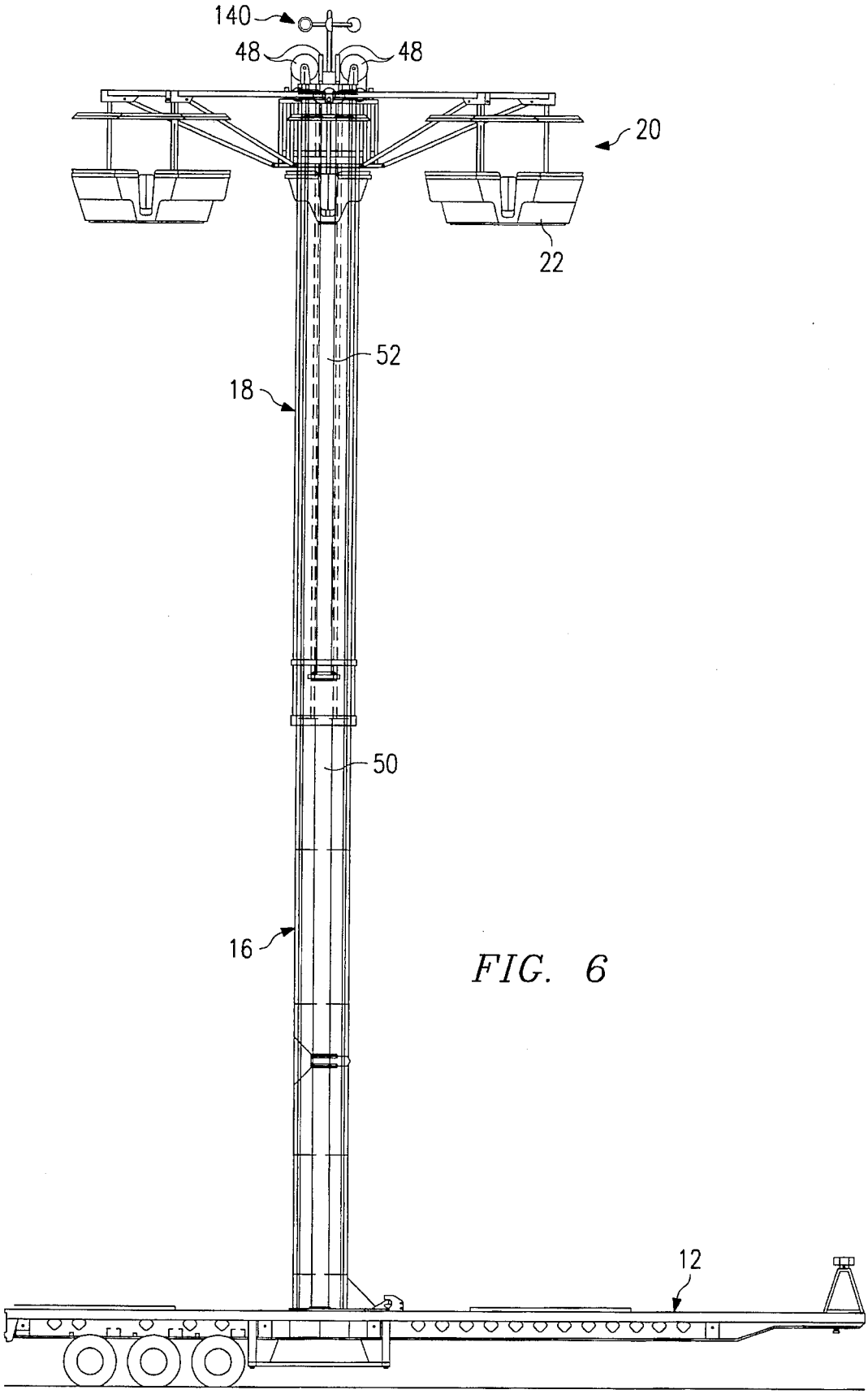
FIG. 6 is a side view of the amusement ride showing the upper tower section and the gondola in the operating position.

Referring to the figures, an amusement ride 10 forming a first embodiment of the present invention is illustrated. The amusement ride 10 includes a trailer 12 and a tower 14 which is movable from the transport position, as seen in FIG. 1 for transporting the amusement ride 10 along the highway, to the erected position, shown in FIGS. 5 and 6. The tower has a lower section 16, an upper section 18 and a gondola 20 supporting a number of gondola cars 22 for passengers. As best seen in FIGS. 5 and 6, the upper section 18 and gondola 20 can be moved between a lowered position, where the gondola is readily accessible for passengers to get on or off of the ride, to the elevated position, seen in FIG. 6, for the actual ride. As will be discussed in greater detail hereinafter, as the upper section 18 rises to the elevated position, the gondola 20 is drawn up at twice the rate of speed of the upper section 18 until the gondola is at the top end of the upper section. This provides both a thrilling ride for the passengers and an attraction to people passing by.

The trailer 12 is generally of conventional design suitable for carrying the ride along the highway. The trailer does have a series of deployable vertical supports 24 which contact the ground and act to stabilize the trailer when the tower is erected and the ride is in use. Further, the trailer mounts a double acting hydraulic cylinder 26 with piston 28. The cylinder 26 is pivoted to the trailer at pivot 30. The hydraulic cylinder 26 will be used to erect the tower as described hereinafter. Also, the trailer mounts a hinge support 32 and a cradle 34 near the front end of the trailer for supporting a portion of the tower 14 when in the transport position as seen in FIG. 1. In the transport position, the tower is positioned on the trailer for the optimal weight distribution for highway trailering.

Figure 2:
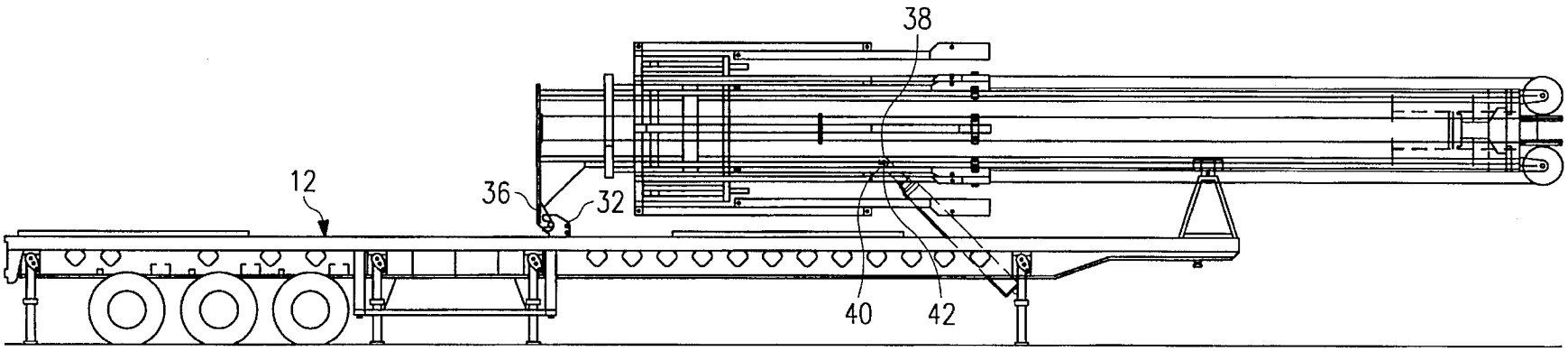
FIG. 2 is a side view of the amusement ride showing the tower moved to the forward position prior to erection.

With reference to FIGS. 1 and 2, when the amusement ride has reached the site where it is to be erected, the piston 28 is hooked to the tower near the middle of the tower. The apparatus, whether locks, straps, bands or other structure, used to secure the tower on the trailer for transport are removed so that the tower is free to move on the trailer. The hydraulic cylinder will then be activated to retract the piston into the cylinder, drawing the tower 14 forward on the trailer until the hinge 36 at the lower end of the lower section 14 engages the hinge support 32 on the trailer. At this point, the tower cannot be moved further forward on the trailer and the hinge is locked in place by the hinge support 32 so that the tower is confined to pivot about the hinge 36 as the tower is further erected.

Figure 3:
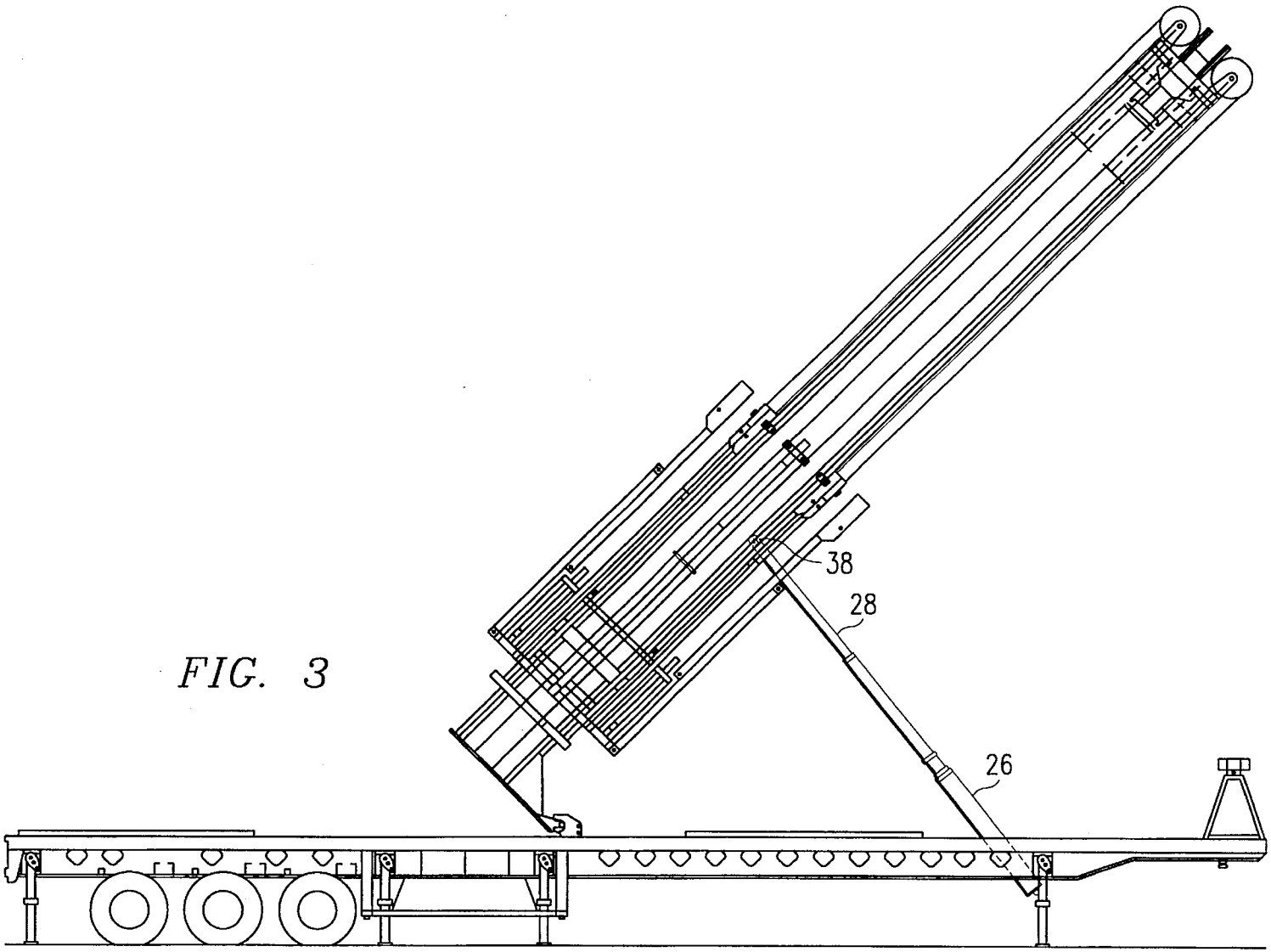
FIG. 3 is a side view showing the tower partially erected.
Figure 4:
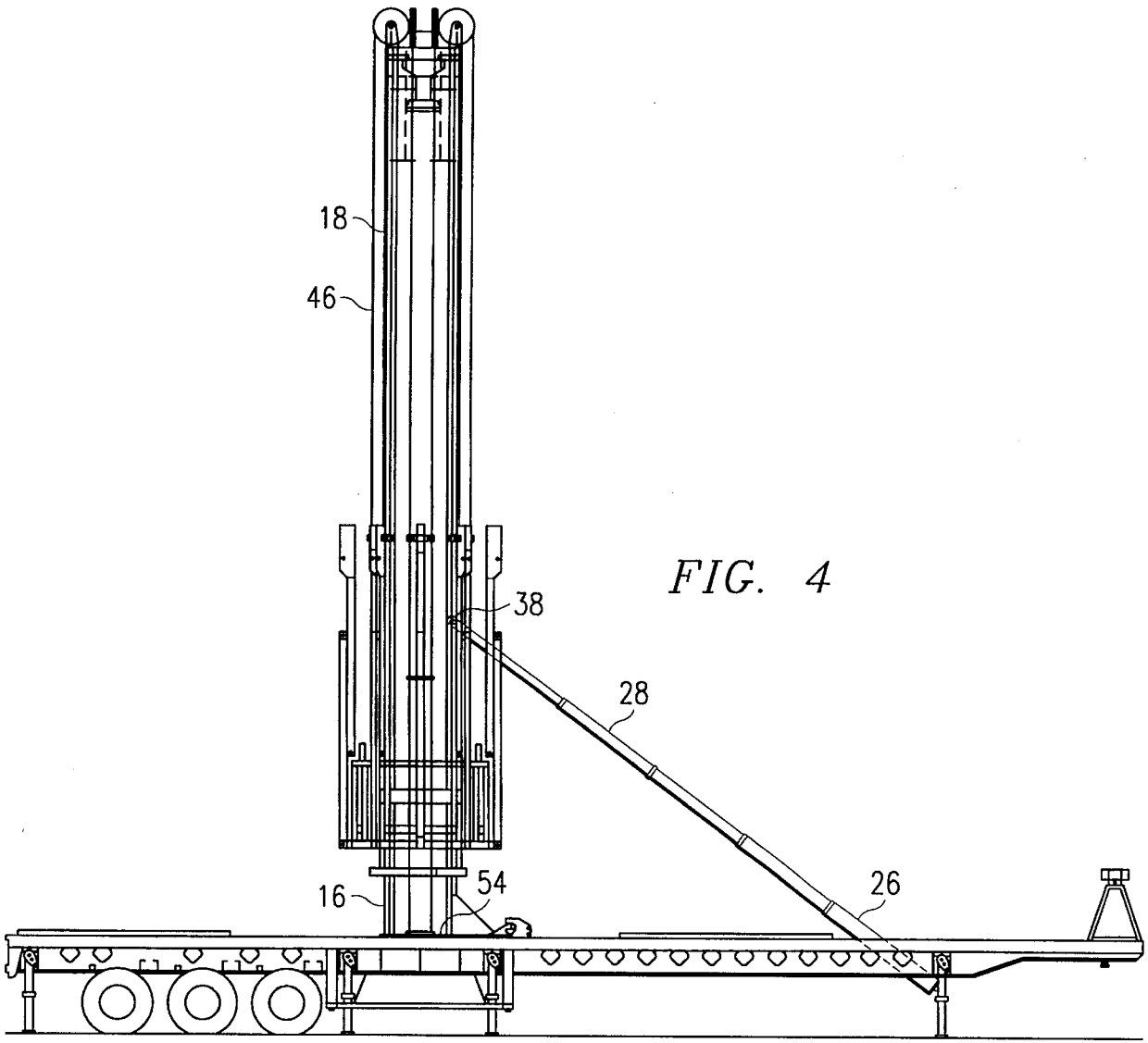
FIG. 4 is a side view of the amusement ride showing the tower in the vertical position.

As best seen in FIG. 3, the hydraulic cylinder 26 is then activated to extend the piston 28. Because the hinge 36 is fixed to the hinge support 32, this motion will cause the tower to pivot vertically until it reaches the vertical, erect position as seen in FIG. 4.

Figure 8:
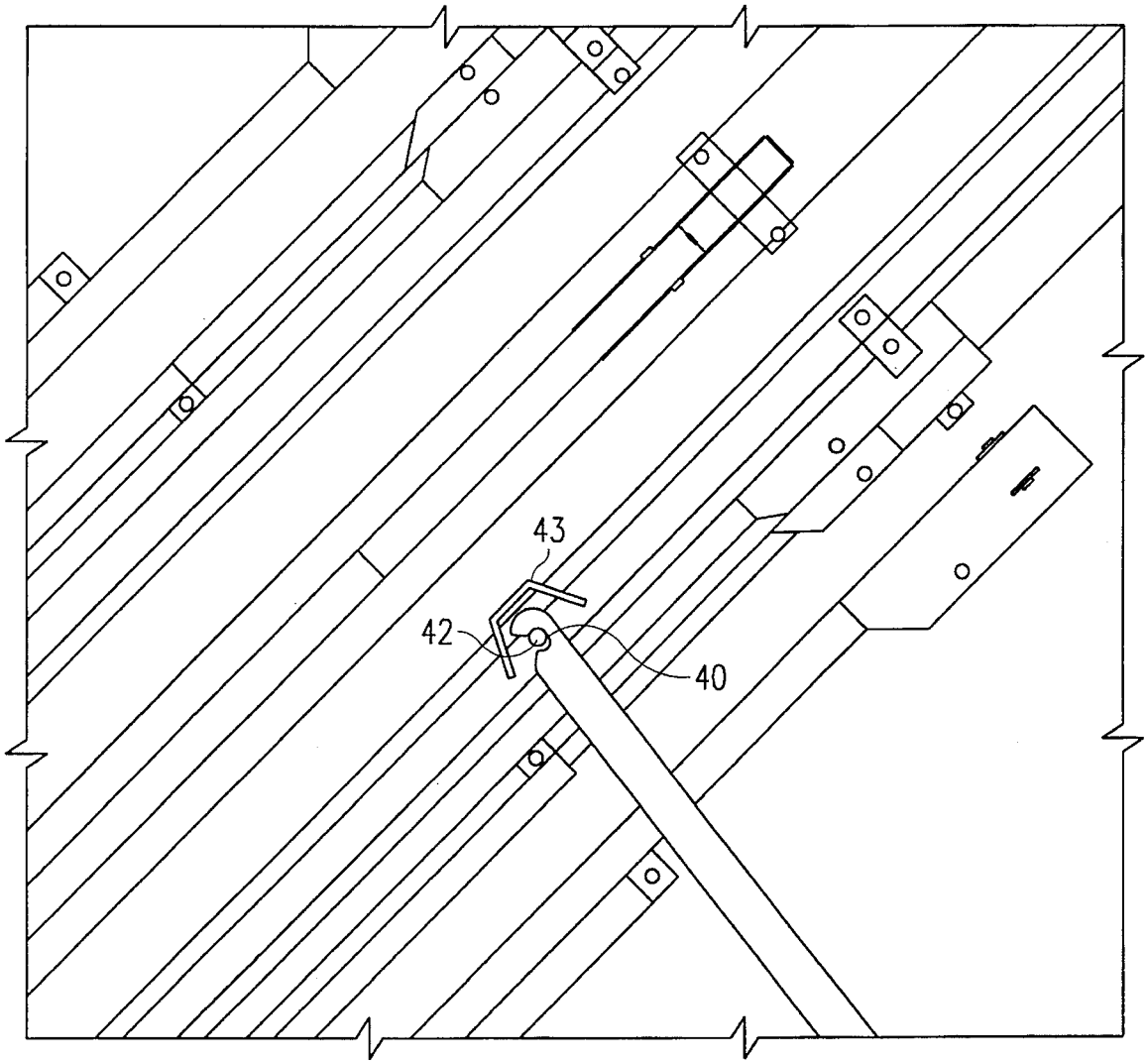
FIG. 8 is a detail view of the hook configuration mounted on the double acting hydraulic cylinder.

Once the tower is erected, the piston 28 will be removed from the lower section 16 and retracted for storage within the trailer until the tower is to be lowered. As seen in FIGS. 1–4, the end 38 of the piston 28 has a hook configuration with an opening 40 to allow the hook to be placed over a lifting pin 42 on the lower section 16. As can be seen, whether the piston is being extended or retracted, the hook can remain engaged with the lifting pin 42. Only when the piston is lifted vertically relative to the lifting pin so that the pin passes out through opening 40 can the piston be removed from a positive connection with the lower section 16. This design is shown in FIG. 8. If the free end of the piston was simply an eye which had to receive a pin inserted therein in a conventional manner, it would be very difficult to attach and detach the double acting cylinder from the tower. In the present invention, there is the large pin 42 permanently mounted in a cup 43 in the wall of the inner tower. The rod end of the double acting cylinder has the notch formed by opening 40, slightly larger than the pin, cut into an elongated slot. All that is required then to hook the cylinder is to extend it into the pocket above the fixed pin in the side of the inner tower. Gravity makes sure that it stays dropped over the pin and because of the notch effect at each end of the slot, either the cylinder is under compression or tension, it is firmly secured to the tower.

Figure 7:
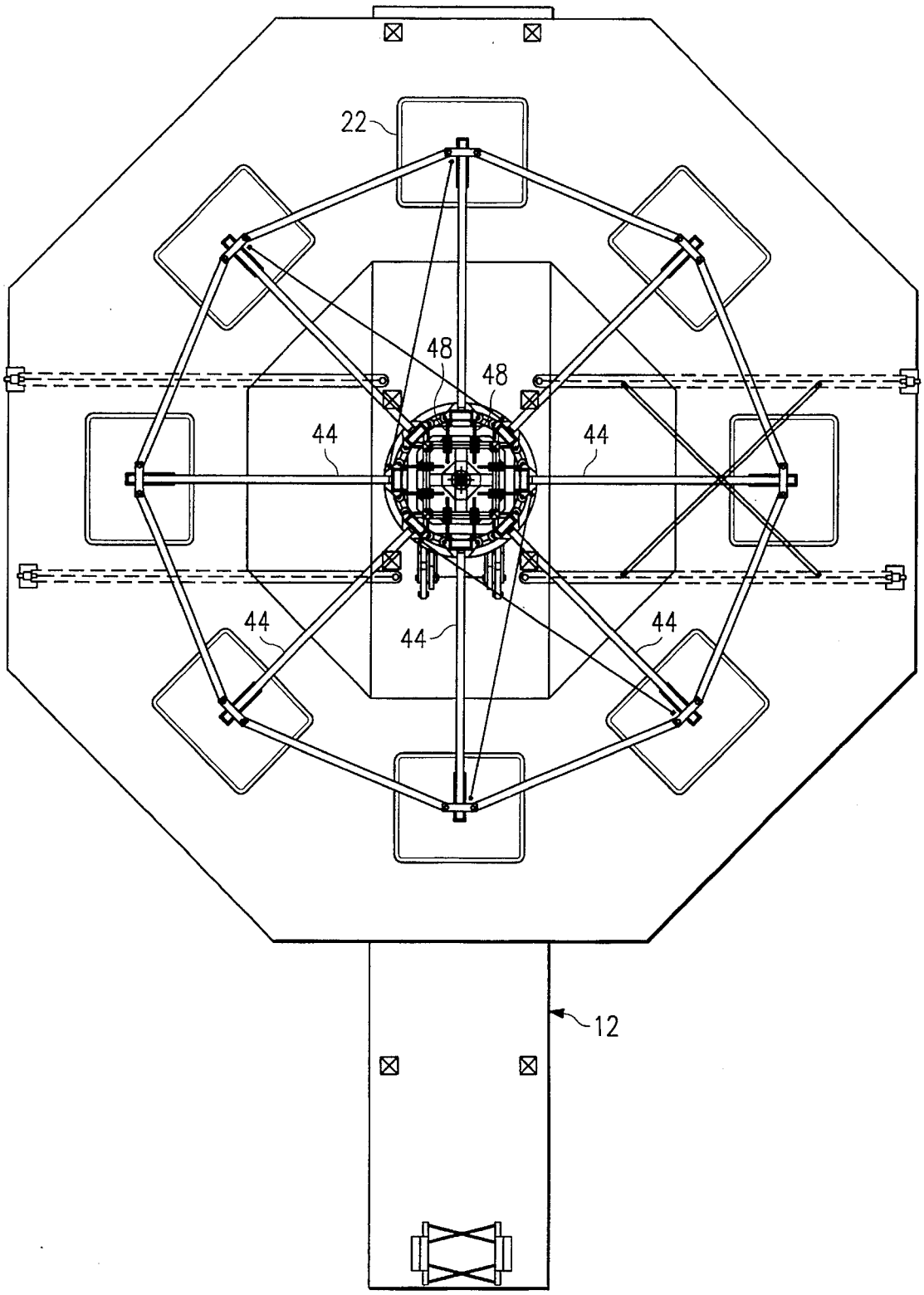
FIG. 7 is a plan view of the amusement ride.

With reference now to FIGS. 5 and 6, once the tower has been erected, the gondola 20, which is supported and guided on the upper section 18, will be deployed from the storage configuration to the operation configuration as seen in FIGS. 5–7. The gondola includes a series of gondola arms 44 which are pivotally attached to the upper section 18 and can pivot between the transport position and the operating position. When the gondola arms 44 are in the operating position, the gondola cars 45 will be mounted on the gondola arms 44. When the tower is in the transport position, the gondola cars 45 are stored on the trailer, usually in front of or behind the tower.

Figure 9:
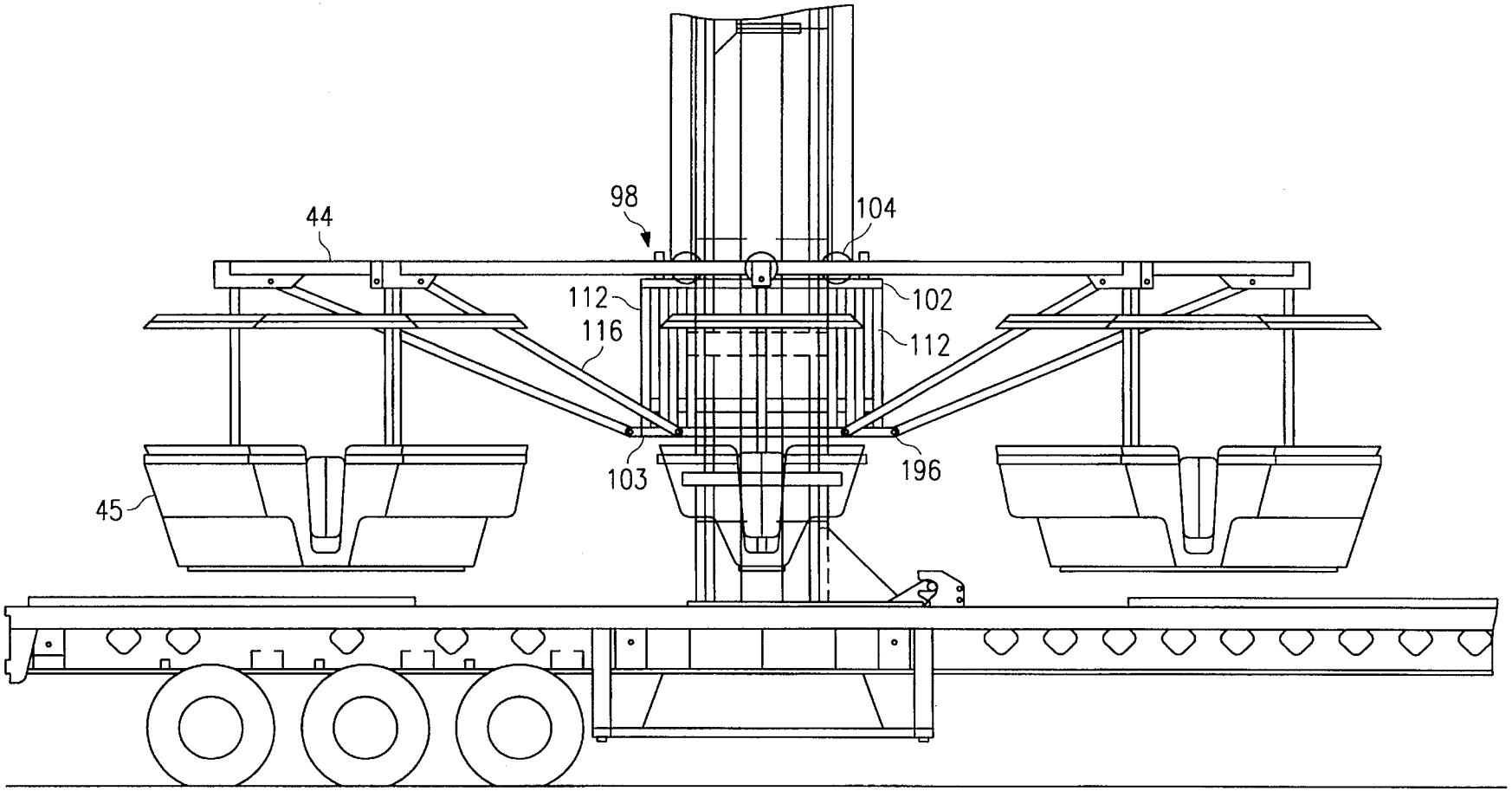
FIG. 9 is a side view of the gondola mechanism illustrating the rotation of the gondola cars relative the tower.
Figure 10:
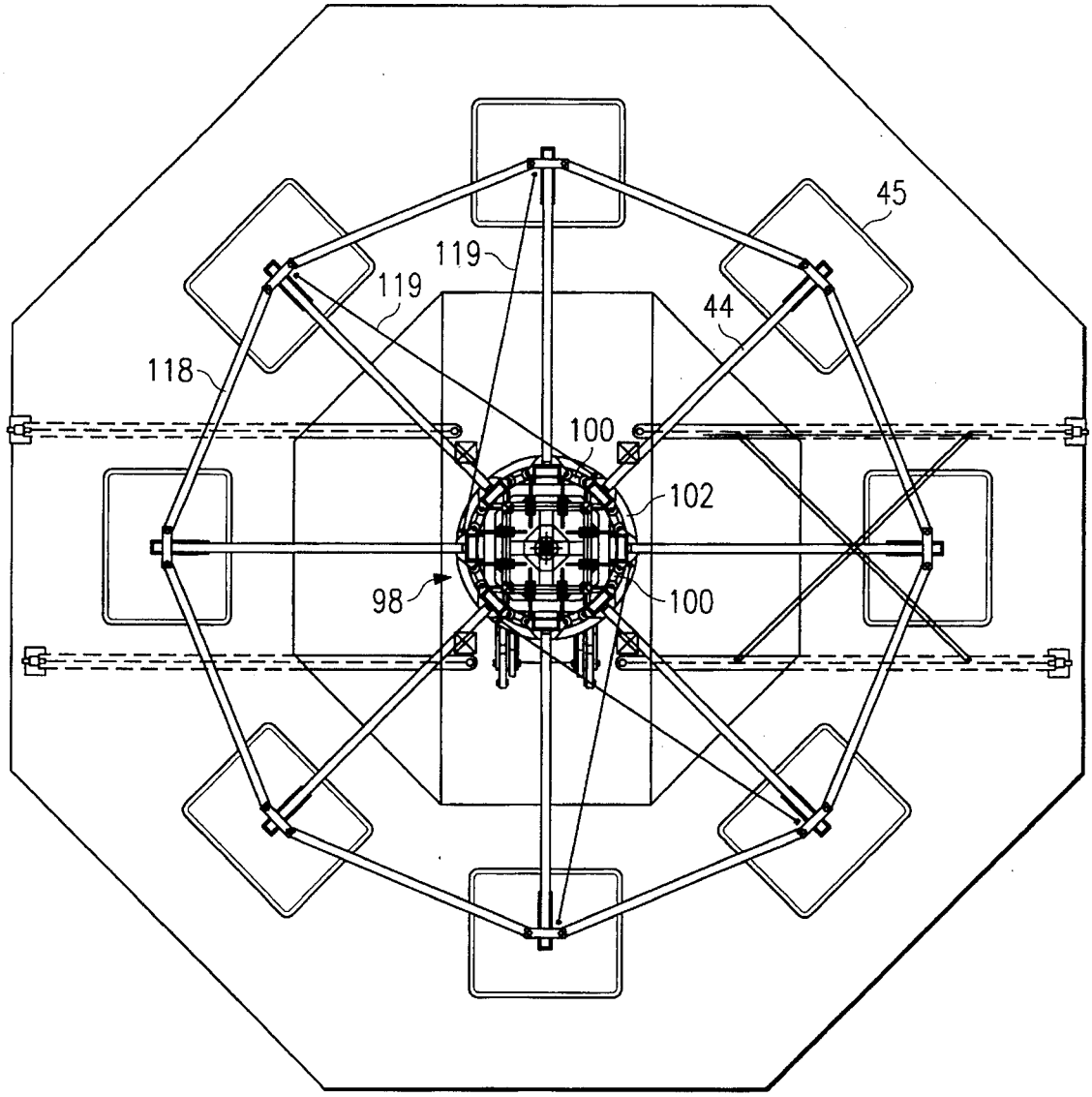
FIG. 10 is a plan view of the gondola arrangement.
Figure 11:
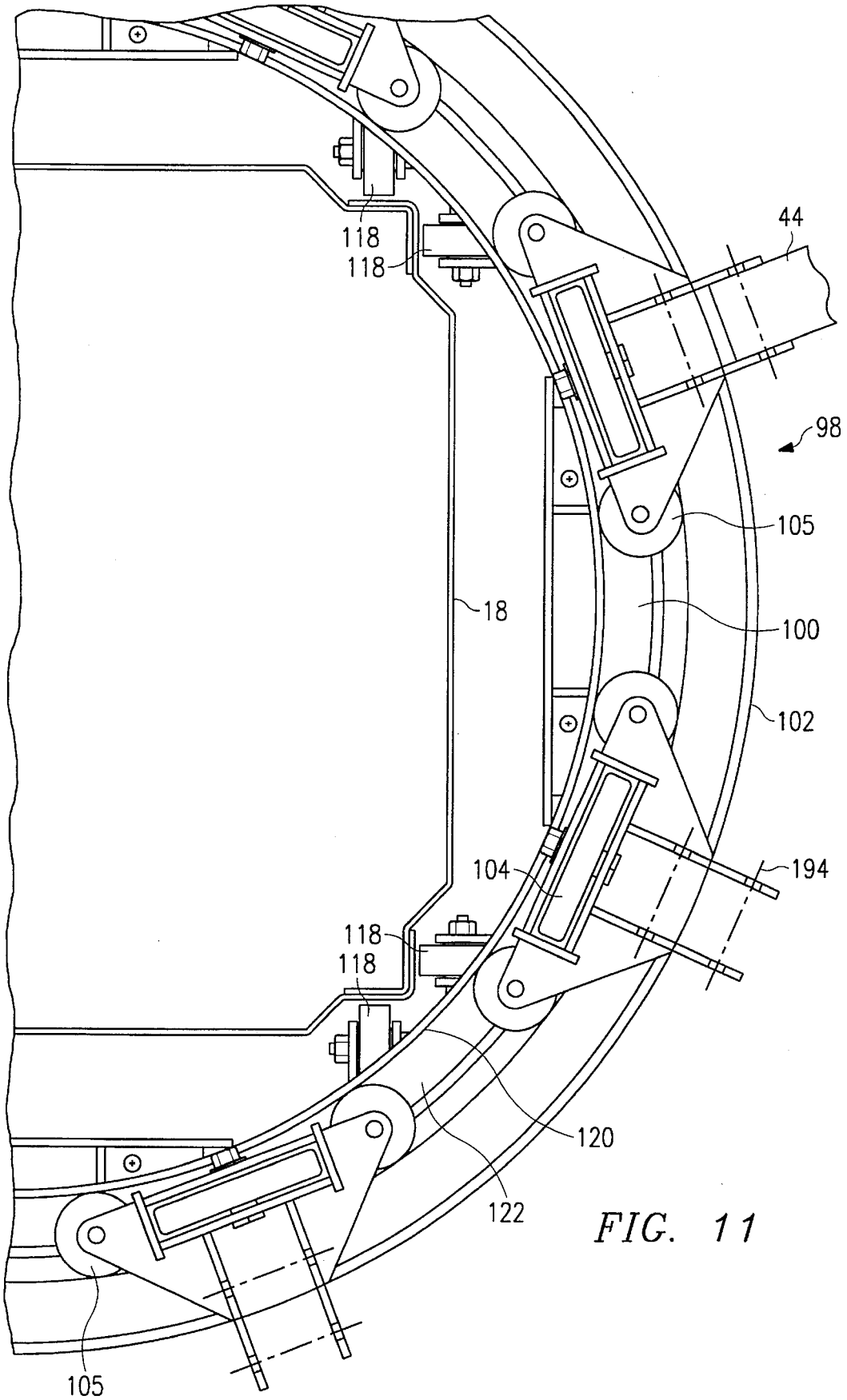
FIG. 11 is a partial plan view of the power ring structure.

With specific reference to FIGS. 9, 10 and 11, a power ring 98 is provided to support and rotate the gondolas. The power ring includes an inner upper ring 100 and inner lower ring 101 (not shown) interconnected by vertical bars 112 to form an inner cylindrical cage. The rings 100 and 101 and bars 112 connecting them do not rotate, but can move vertically relative to the upper section 18 through a series of guide wheels 118 mounted on the inner cage, bearing against the outer surface of the upper section as seen in FIG. 11. Preferably, eight guide wheels 118 are distributed about the inner cage near the inner upper ring 100 and eight guide wheels 118 are mounted on the inner cage near the inner lower ring 101 spaced vertically below the upper set of guide wheels. The inner upper ring 100 defines an outwardly facing annular vertical surface 120 and an upwardly facing horizontal arcuate surface 122. The inner lower ring 101 defines an outwardly facing vertical annular surface 124 (not shown).

The power ring 98 also includes a rotating cage assembly including an outer upper ring 102 and an outer lower ring 103 interconnected by vertical bars 112. Outer upper ring 102 is supported on the inner ring through guide wheels 104 mounted on ring 102 which run along horizontal surface 122 which permit the outer ring 102 to rotate relative the inner ring 100 about the elongate axis of the tower. Guide wheels 105 are also mounted on the outer upper ring 102 which bear against the vertical annular surface 120 to maintain the axis of the rings 100 and 102 concentric as the gondolas rotate about the vertical axis of the tower. One or more electric motors are mounted on the inner ring 100 and rotate the outer cage at outer ring 102 through fluid couplings and friction members bearing against outer upper ring 102. The friction members are typically aluminum wheels with urethane tread mounted thereon which have a frictional engagement with the outer upper ring 102 assisted by a spring force. However, any other suitable drive mechanism could be used, such as a DC motor drive, a hydraulic drive or other suitable drive mechanism. The outer lower ring 103 mounts a series of guide wheels 126 (not shown) which bear against the inner lower ring 101 to assist in maintaining the outer cage concentric with the inner cage as it rotates.

The inner end of each arm 44 is pivotally secured at pivot 194 to outer upper ring 102 while the inner end of a brace arm 116 is pivotally secured at pivot 196 to the outer lower ring 103 directly beneath the arm 44. The opposite end of the brace arm 116 is secured near the outer end of the arm 44 to provide rigidity. The individual gondola cars 45 are suspended directly off of the end of the arms 44. Arms 118 also are mounted between the outer ends of adjacent arms 44 and wire cables 119 tensioned as shown for enhanced stability. To move the ride into the storage position, the outer end of the brace arms 116 are simply disconnected from the arms 44 and both arms 44 and brace arms 116 are pivoted relative the outer upper ring 102 and outer lower ring 103 to lie parallel the length of the tower, as seen in FIG. 1. Arms 118 and gondola cars 45 are removed prior to pivoting the arms 44 and 116 into the transport position.

Eight cables 46 are secured at one end inner ring 100 and at the other end to the lower section 16 near the base of the lower section. Between the ends, the eight cables 46 pass over dedicated cable pulleys 48 mounted at the upper end of the upper section 18. The pulleys are mounted symmetrically at the top of the upper section, as seen in FIG. 7, in pairs to effectively distribute the force loads exerted thereon.

A lifting cylinder 50 is mounted within the lower section 16 and secured at its lower end to the bottom of the lower section 16. The piston 52 of the cylinder is attached at its exterior end to the top of the upper section 18. As hydraulic fluid is supplied to the lifting cylinder 50, the piston 52 will move vertically out of the cylinder, causing the upper section 18 to rise vertically relative to the lower section 16 and trailer 14. Because of the geometry of the cable placement, the gondola will also rise, guided by the exterior surface of the upper section, but at a velocity twice the rate of the lifting of the upper section 18 and piston 52. When the piston 52 is fully extended as seen in FIG. 6, the gondola 20 is positioned at the upper end of the upper section 18.

The gondola cars 45 can be rotated about the vertical axis to enhance the experience of the passengers. The gondola cars can be rotated as they are lifted and lowered vertically by the cylinder 50 and when they are in the elevated position seen in FIG. 6. Alternatively, the gondola cars can be lifted without rotating and rotation initiated only when it is in the lifted position as seen in FIG. 6.

The upper section 18 is supported on the piston 52. The lower section 16 includes guides which assist the upper section 18 to smoothly move in the vertical direction, but the lower section does not otherwise support the upper section. Similarly, the cable pulleys 48 are mounted on the upper section immediately proximate the end of the piston 52. Thus, the large force carrying components of the upper section are in a compact configuration which allows for minimization of materials and cost. The portion of the upper section which extends downward acts as a guide for the power ring but otherwise is essentially decorative and serves only to hide the inner working components of the ride, such as the cylinder 50 and piston 52.

Preferably, load cells 54 are mounted at each anchor point of a cable 46 to the base of the lower section 16. This allows the operator to continuously monitor the force exerted by the cables and to take appropriate action if the forces become unbalanced. The load cells provide a very important feature from an operational and safety standpoint. The gondola cars are preferably rotated about the vertical axis by two one horsepower motors. The power for the motors is supplied through bus bars extending along the lower and upper sections 16 and 18.

When the ride is over, the piston 52 is lowered within cylinder 50 to lower the upper section 18 and the gondola 20. Again, the gondola will fall at a rate twice as fast as the upper section 18. By the time the piston 52 returns to its fully retracted position, the gondola 20 will have moved to its lowest position, where the passengers can be unloaded and new passengers embark.

When the ride is to be transported to another site, the tower is lowered by the hydraulic cylinder 26 by simply reversing the process described above in erecting the tower. The hinge 36 is released from the hinge support 32 and the hydraulic cylinder 26 drives the tower rearward on the trailer 12 until the tower is in the transport position as seen in FIG. 1.

A weather station is preferably mounted at the top of the upper section 18. The wind velocity will be measured by this station and the operator will be warned to lower the section 16 and gondola 20 should the winds become severe.

In one amusement ride constructed in accordance with the teachings of the present invention, travel of the piston 52 is about 40 feet. The gondola 20 will be lifted eighty feet as it moves from its lowest position to its highest position as the piston is extended. The piston 28 will extend sixteen feet.

In another embodiment, the upper section of the tower can be separate from the gondola and lifting cylinder. As such, the tower can be raised to the elevated position and locked in place. The hydraulic cylinder can then be activated to lift the gondola cars and operating mechanisms to the elevated position.

Figure 12:
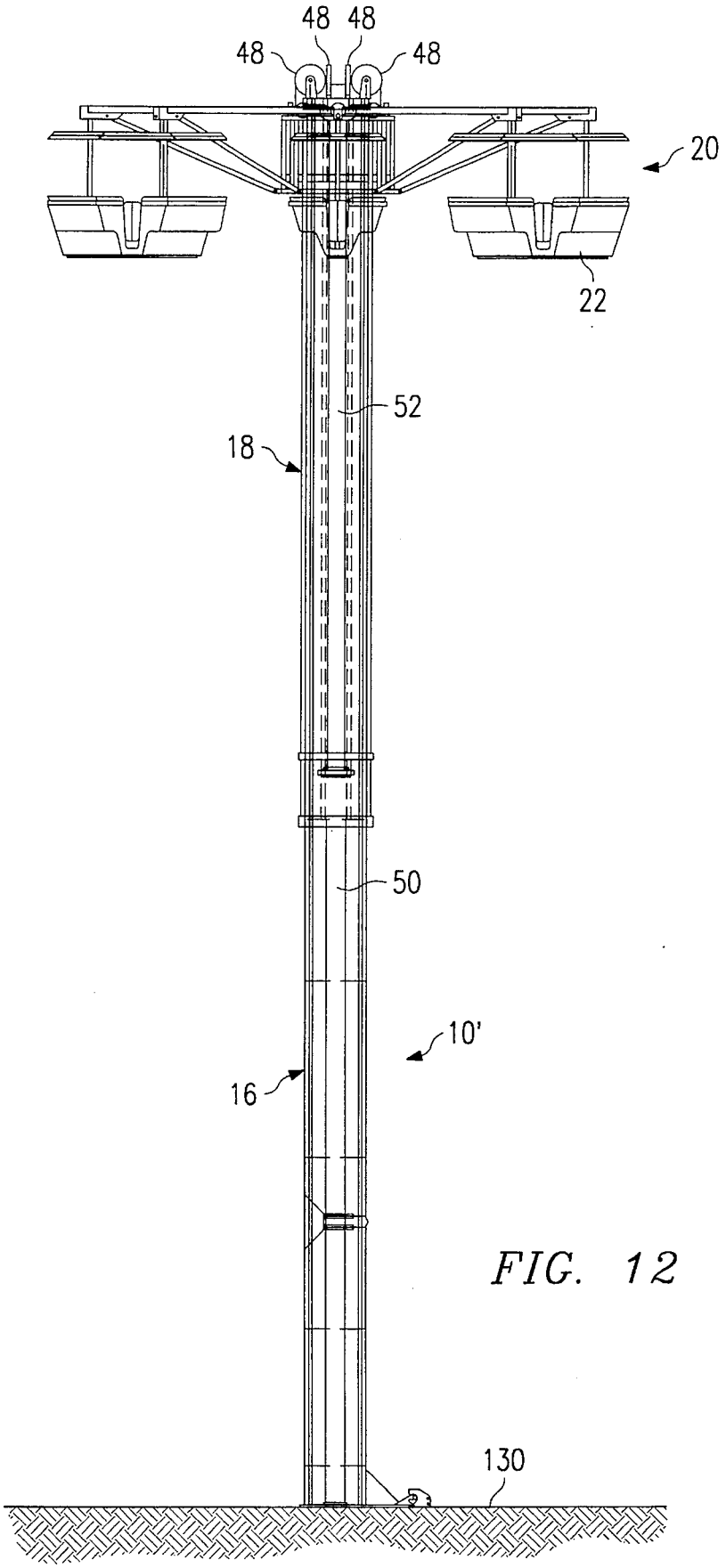
FIG. 12 is an illustrative view of another embodiment of the present invention showing the amusement ride permanently installed at a park or similar facility.

The amusement ride can also be a permanently installed ride at an amusement park or other facility as shown in FIG. 12 as ride 10'. As such, the tower would raise and lower just as discussed above. There would be no need to tilt the tower, however, except in installing the tower and when its service is complete. In the interim, the tower can be permanently mounted in the ground 130 in the vertical position by any acceptable structure, such as a concrete base, metal base, etc., for Use.

Although the present invention has been described with respect to a specific preferred embodiment thereof, various changes and modifications may be suggested to one skilled in the art, and it is intended that the present invention encompass such changes and modifications as fall within the scope of the appended claims.

I claim:

1. An apparatus, comprising:

a platform;

a tower assembly having a base end and an upper end movable horizontally between a storage position and a vertical erected position on the platform;

a double acting hydraulic cylinder mounted between the platform and the tower assembly moving the entire tower assembly horizontally relative the platform with the base end moving from the storage position to an intermediate position;

pivot structure mounted on the platform to hingeably secure the base end of the tower assembly about a horizontal axis in the intermediate position, so that only pivotal motion of the base end about the horizontal axis is required to position the tower assembly in the erected position; and the double acting hydraulic cylinder pivoting the tower assembly about the pivot structure and horizontal axis to lift the tower assembly to the erected position, only a said double-acting hydraulic cylinder being required to move the tower assembly horizontally relative the platform and to pivot the tower assembly relative the platform to the vertical erected position.

2. The apparatus of claim 1 wherein the tower assembly has a lower section and an upper section, the tower assembly further having a hydraulic cylinder assembly to vertically lift the upper section relative the lower section to extend the height of the tower assembly.

3. The apparatus of claim 2 further comprising a gondola supported on the upper section of the tower assembly.

4. The apparatus of claim 1 further comprising a gondola mounted on the tower assembly.

5. The apparatus of claim 4 further comprising structure for rotating the gondola about a vertical axis with the tower assembly in the erected position.

6. The apparatus of claim 4 further comprising structure for lifting the gondola vertically along the tower assembly with the tower assembly in the erected position.

7. The apparatus of claim 1 wherein the platform has a center, the tower assembly in the erected position being at the center of the platform, the tower assembly in the storage position being positioned with the base end of the tower assembly spaced horizontally from the center of the platform, the double-acting hydraulic cylinder moving the tower assembly horizontally relative the platform with the base end moving from the storage position to the intermediate position, the intermediate position being positioned at the center of the platform, the pivot structure mounted to the platform at the center of the platform to hingeably secure the base of the tower assembly in the intermediate position.

8. An apparatus, comprising:

a platform;

a tower assembly having a base end and an upper end moveable between a storage position and an erected position on the platform;

a double-acting hydraulic cylinder mounted between the platform and the tower assembly moving the tower assembly relative the platform with the base moving from the storage position into an intermediate position;

pivot structure mounted on the platform to hingeably secure the base of the tower assembly in the intermediate position;

the hydraulic cylinder pivoting the tower assembly about the pivot structure to lift the tower assembly to the erected position;

the tower assembly having a lower section and an upper section, the tower assembly further having a hydraulic cylinder assembly to vertically lift the upper section relative the lower section to extend the height of the tower assembly;

a gondola supported on the upper section of the tower assembly; and the apparatus further comprising a power ring, the power ring including a fixed ring and a rotatable ring rotating on said fixed ring, the gondola supported on said rotating ring.

9. An apparatus, comprising:

a platform;

a tower assembly having a base end and an upper end moveable between a storage position and an erected position on a platform;

a double-acting hydraulic cylinder mounted between the platform and the tower assembly moving the tower assembly relative the platform with the base moving from the storage position to an intermediate position;

pivot structure mounted on the platform to hingeably secure the base of the tower assembly in the intermediate position;

the hydraulic cylinder pivoting the tower assembly about the pivot structure to lift the tower assembly to the erected position;

the tower assembly having a lower section and an upper section, the tower assembly further having a hydraulic cylinder assembly to vertically lift the upper section relative the lower section to extend the height of the tower assembly;

a gondola supported on the upper section of the tower assembly; and at least one flexible member having a first end and a second end, a first end of the member attached to the gondola and the second end of the member attached to the lower section, the member constrained for vertical movement with the upper section, vertical movement of the upper section relative to the lower section causing vertical movement of the gondola relative to the lower section at a velocity approaching twice the velocity of movement of the upper section.

10. An amusement ride, comprising:

a lower section;

an upper section having an upper end;

a device for lifting the upper section vertically relative to the lower section between a retracted position and an extended position;

an element positioned proximate the upper section;

at least one constant length flexible member attached at one end to the element and at the other end to the lower section, the member passing over the upper end of the upper section, the device for lifting the upper section lifting the element through the flexible member at a rate twice as fast as the upper section is lifted.

11. The amusement ride of claim 10 wherein the upper end of the upper section has a guide pulley mounted thereon, the constant length flexible member constrained about the guide pulley.

12. The amusement ride of claim 10 wherein the amusement ride has eight constant length flexible members and the upper end of the upper section has eight guide pulleys mounted therein, each flexible member guided by one of the guide pulleys.

13. The amusement ride of claim 10 further comprising a load cell interconnected with the flexible member to measure the tension in the flexible member.

14. The amusement ride of claim 10 further comprising a weather station mounted at the upper end of the upper section, said weather station including a wind measuring device.

15. The amusement ride of claim 10 further including a trailer, the lower section being mounted on the trailer for movement between a transport position and an erected position, the lower section having a base, the base having a side including a pivot, the trailer having a pivot mount to receive the pivot of the base, the trailer having a double acting hydraulic cylinder to move the lower section from a transport position to an intermediate position with the hinge engaging the hinge mount, the hydraulic cylinder pivoting the lower section about the hinge to raise the lower section to an erect position.

16. The amusement ride of claim 10 wherein the device for lifting the upper section is a hydraulic cylinder with the piston mounted to the upper section and the cylinder mounted to the lower section.

17. The amusement ride of claim 10 wherein the element is a gondola, the amusement ride further including structure for rotating the gondola about a vertical axis relative to the upper section.

18. The amusement ride of claim 10 wherein the element is a gondola and wherein the gondola includes at least one arm and a load ring, the arm pivoted to the load ring, the arm pivoting between an extended position and a storage position where the arm is parallel the length of the upper and lower sections in the storage position.

19. The amusement ride of claim 10 wherein the element is a load bearing ring for bearing a passenger carrying platform.

20. An amusement ride, comprising:

a trailer;

a tower assembly, the tower assembly having a lower section and an upper section, the lower section having a base and the upper section having an upper end;

a double acting hydraulic cylinder mounted on the trailer, the hydraulic cylinder having a piston with a hook at an end of the piston, the hook being hooked to the tower assembly to move the tower between a travel position where the tower assembly is balanced on the trailer to an intermediate position, the base of the lower section having a hinge, the trailer having a hinge structure, the hydraulic cylinder moving the tower assembly from the travel position to the intermediate position to engage the pivot in the pivot structure, the hydraulic cylinder pivoting the tower assembly about the pivot to move the tower assembly to a vertical position;

a second hydraulic cylinder, the cylinder mounted to the base of the upper section, the second hydraulic cylinder having a piston, an end of the piston connected to the upper section, the second hydraulic cylinder lifting the upper section relative to the lower section between a lowered position and an elevated position;

a gondola concentric with the lower and upper sections of the tower assembly;

a plurality of cables, each cable attached at one end to the gondola and at the other end to the base of the lower section, the upper end thereof to guide each of the cables, the second hydraulic cylinder moving the gondola vertically as the upper section is moved between the lower position and the elevated position, the gondola moving at a rate of speed twice the rate of speed of the upper section.

21. The amusement ride of claim 20 further including a weather station mounted at the upper end of the upper section to monitor wind velocity.

22. The amusement ride of claim 20 further including a load cell mounted to each of the cables to monitor the tension in the cables.

23. The amusement ride of claim 20 including structure for rotating the gondola about a vertical axis.

24. The amusement ride of claim 20 wherein the gondola includes gondola arms and gondola cars, the gondola arms being pivotally mounted to move between a folded position and a deployed position, the arms being moved to the folded position with the tower assembly in the travel position.

* * * * *